US008985836B2

(12) United States Patent
Shiono

(10) Patent No.: US 8,985,836 B2
(45) Date of Patent: Mar. 24, 2015

(54) LIQUID STIRRING DEVICE

(75) Inventor: Shohei Shiono, Matsumoto (JP)

(73) Assignee: Seiko Epson Corporation (JP)

( * ) Notice: Subject to any disclaimer, the term of this patent is extended or adjusted under 35 U.S.C. 154(b) by 986 days.

(21) Appl. No.: 13/105,918

(22) Filed: May 12, 2011

(65) Prior Publication Data

US 2011/0280098 A1 Nov. 17, 2011

(30) Foreign Application Priority Data

May 12, 2010 (JP) ..... 2010-110317
Aug. 11, 2010 (JP) ..... 2010-180102

(51) Int. Cl.
*B41J 2/175* (2006.01)

(52) U.S. Cl.
CPC ..... *B41J 2/175* (2013.01); *B41J 2/17513* (2013.01)
USPC ..... 366/111; 347/86; 366/114; 366/118; 366/126; 366/219; 366/239; 366/240; 366/244; 366/333; 366/342; 366/343

(58) Field of Classification Search
USPC ..... 366/111, 114, 118, 126, 219, 239, 240, 366/244, 333, 342, 343; 347/86
See application file for complete search history.

(56) References Cited

U.S. PATENT DOCUMENTS 4,880,465 A 11/1989 Loria et al.
7,192,128 B1 * 3/2007 Hattori et al. ..... 347/86
7,914,101 B2 3/2011 Ohashi et al.
7,992,984 B2 8/2011 Toba et al.
2007/0052773 A1 * 3/2007 Kawamura et al. ..... 347/86
2009/0033725 A1 * 2/2009 Toba et al. ..... 347/86
2010/0172204 A1 * 7/2010 Okito et al. ..... 366/343
2012/0033004 A1 * 2/2012 Shiono ..... 347/6

FOREIGN PATENT DOCUMENTS

JP 05-229140 9/1993
JP 08-127747 5/1996
JP 2000-239585 9/2000
JP 2002-225255 8/2002
JP 2003-165231 6/2003
JP P3562754 6/2004
JP 2006-272648 10/2006
JP 2007-111899 A 5/2007
JP 2007-136980 A 6/2007
JP 2007-301772 A 11/2007
JP 2009-034889 A 2/2009

(Continued)

OTHER PUBLICATIONS

Patent English Abstract of JP 2000-239585 Published Sep. 5, 2000 and Machine English Translation.

(Continued)

*Primary Examiner* — Robert B Davis
(74) *Attorney, Agent, or Firm* — Harness, Dickey & Pierce, P.L.C.

(57) ABSTRACT

A liquid supply device according to the invention includes a container which is filled with a liquid from a liquid storage portion, and the container includes a bottom surface portion, an upper surface portion, and a stirrer which moves in the bottom surface portion and stirs the liquid. The relationship between a height Ht in the vertical direction of a central portion in the container and a height Hb in the vertical direction of the stirrer satisfy the Expression: $0.40 \times Ht \leq Hb \leq 0.90 \times Ht$.

6 Claims, 7 Drawing Sheets

(56) References Cited

FOREIGN PATENT DOCUMENTS

| | | |
|---|---|---|
| JP | 2010-89477 | 4/2010 |
| JP | 2010-131976 | 6/2010 |
| JP | 2010-158868 | 7/2010 |
| JP | 2010-184424 | 8/2010 |
| JP | 2011-5717 | 1/2011 |

OTHER PUBLICATIONS

Patent English Abstract of JP2002-225255 Published Aug. 14, 2002 and Machine English Translation.
Patent English Abstract of JP2003-165231 Published Jun. 10, 2003 and Machine English Translation.
Patent English Abstract of JP3562754 Published Jun. 11, 2004 and Machine English Translation.
Patent English Abstract of JP2006-272648 Published Oct. 12, 2006 and Machine English Translation.
Patent English Abstract of JP2010-131976 Published Jun. 17, 2010 and Machine English Translation.
Patent English Abstract of JP2010-158868 Published Jul. 22, 2010 and Machine English Translation.
Patent English Abstract of JP2010-184424 Published Aug. 26, 2010 and Machine English Translation.
Patent English Abstract of JP2010-89477 Published Apr. 22, 2010 and Machine English Translation.
Patent English Abstract of JP2011-5717 Published Jan. 13, 2011 and Machine English Translation.

* cited by examiner

LIQUID STIRRING DEVICE

BACKGROUND

1. Technical Field

The present invention relates to a liquid stirring device.

2. Related Art

There are known ink supply systems which supply ink to an ejection head capable of ejecting ink from an ink tank storing ink via an ink supply tube. When such ink supply systems are used, when ink supply is not performed for a long period of time after the supply of ink to the ejection head, components which are contained in the ink which remains in the flow passage of the ink supply tube precipitate in some cases. When the components contained in the ink precipitate, it is not possible to stably supply ink to the ejection head when ink is again supplied to the ejection head, or an ejection error may be caused.

Particularly, when inorganic pigments (for example, titanium oxide), metal pigments (for example, aluminum) or the like are contained as components in the ink, there is a problem in that these pigments easily precipitate in view of differences in the specific gravity between the pigments and the solvent.

Regarding this problem, for example, in JP-A-2006-272648, there is a description of an ink supply system which is provided with a sub-tank to always hold a certain amount of ink in an ink flow passage. In addition, in JP-A-2006-272648, there is a description of a stirring ball which is provided in the sub-tank in order to stir the ink in the sub-tank. Due to the provision of the sub-tank, it is possible to reduce the amount of precipitated components, such as a pigment, which is contained in ink.

However, in the related art in JP-A-2006-272648, the stirring ball is difficult to move in the sub-tank, or liquid stirring efficiency is reduced in some cases.

SUMMARY

An advantage of some aspects of the invention is to provide a liquid stirring device which has excellent liquid stirring efficiency by solving the problems, and a liquid ejection device which uses the liquid stirring device to make ejection errors less apt to occur.

The invention is contrived to solve at least some of the above-described problems and can be realized as the following aspects or applications.

Application 1

According to an aspect of the invention, a liquid stirring device includes: a liquid storage portion in which a liquid containing a component which may precipitate is stored; a container to which the liquid flows from the liquid storage portion; a stirrer which is housed in the container and stirs the liquid; and a bottom surface portion which constitutes the interior of the container and in which the stirrer moves. The relationship between a height Ht in the vertical direction of a central portion in the container and a height Hb in the vertical direction of the stirrer satisfies the following Expression 1: $0.40 \times Ht \leq Hb \leq 0.90 \times Ht$.

According to Application 1 of the invention, since Ht and Hb satisfy the above relational expression, the stirrer can be easily moved in the container and a liquid stirring device having excellent liquid stirring efficiency can be obtained.

Application 2

It is preferable that the component is contained at a predetermined concentration in the liquid stored in the liquid storage portion, and it is preferable that the relationships between a height Hi in the vertical direction of precipitates of the component which is contained in the liquid in the container, Ht, and Hb satisfy the following Expressions 2-1 and 2-2: $Hi \div Ht \leq 0.26$ and $2.50 \times Hi \leq Hb \leq 0.90 \times (Ht - Hi)$.

According to Application 2 of the invention, since Ht, Hb, and Hi satisfy the above relational expressions, superior stirring can be performed, and even when the precipitates are solidified, a liquid stirring device having excellent liquid stirring efficiency can be obtained.

Application 3

It is preferable that the bottom surface portion has a shape which is curved downward in the vertical direction when viewed from the cross-section in a direction which is perpendicular to the direction in which the stirrer is moved and is perpendicular to the vertical direction.

According to Application 3 of the invention, the precipitated component easily accumulates in the curved portion and the stirrer is moved around the curved portion. Therefore, the stirring efficiency of the precipitated component increases.

Application 4

It is preferable that the container has a side surface portion which is provided in the direction in which the stirrer is moved, and it is preferable that a connecting portion between the side surface portion and the bottom surface portion has a shape which is curved toward the outside of the container.

According to Application 4 of the invention, the clearance gap in the vicinity of the connecting portion is reduced, and thus the stirrer easily comes into contact with the precipitated component and the precipitated component is also efficiently stirred, whereby the stirring efficiency increases.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
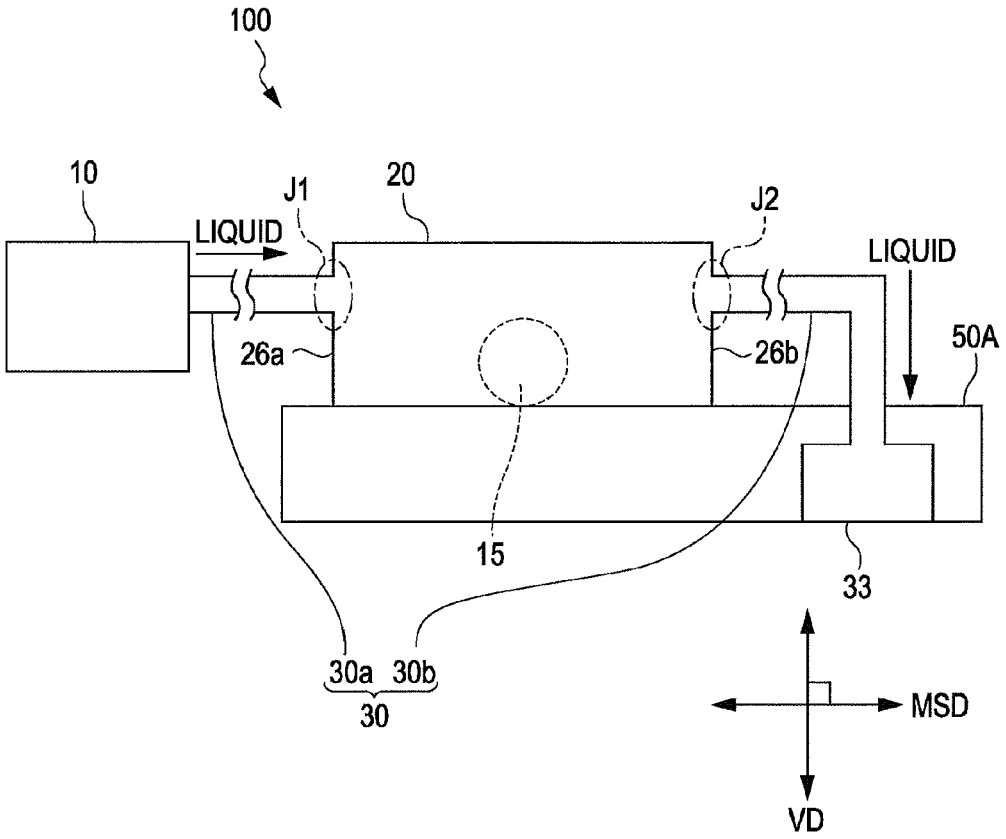
FIG. 1 is a side view schematically showing a liquid stirring device according to an embodiment.

Hereinafter, embodiments of the invention will be described. However, the invention is not limited to these embodiments.

1. Liquid Stirring Device

A liquid stirring device according to this embodiment has a container, a stirrer which is disposed in the container, and a carriage. A liquid stirring device 100 according to this embodiment shown in FIG. 1 has a liquid storage portion 10, a container 20, a liquid supply tube 30, and an ejection head 33. The container 20 and the ejection head 33 are mounted on a carriage 50A. The container 20 includes a stirrer 15 therein. The carriage 50A can reciprocate in a predetermined direction MSD (hereinafter, referred to as the "longitudinal direction").

1.1. Liquid Storage Portion

The liquid stirring device 100 according to this embodiment may have the liquid storage portion 10. The liquid storage portion 10 stores liquid which contains a component at a predetermined concentration. In this specification, the "predetermined concentration" is a concentration when a component which may precipitate is sufficiently stirred in the liquid storage portion 10. The liquid storage portion 10 shown in FIG. 1 is connected to the container 20 via the liquid supply tube 30*a*. Accordingly, it is possible to allow the liquid to flow to the container 20.

In this specification, the liquid may contain a component which may precipitate, and examples of the component include a dispersion such as an emulsion and a suspension. Examples of the liquid which is stored in the liquid storage portion 10 include an ink composition, material for organic EL display, a material for a color filter for liquid crystal display, a material for field emission display (FED), a material for a color filter or an electrode for electrophoretic display, a bioorganic material used in bio-chip manufacturing, and the like.

In addition, "precipitation" means that when a liquid is left for a certain period of time, the component contained therein settles and accumulates in the lower layer of the liquid. A component having high specific gravity with respect to the solvent is exemplified. An ink composition may contain, for example, one type selected from among an inorganic pigment, a metal pigment and hollow resin particles, or may contain a component which combines or adsorbs these.

Examples of the inorganic pigment include titanium dioxide, silicon oxide, aluminum oxide, zinc oxide, iron oxide, carbon black, and the like. Examples of the metal pigment include a single substance such as aluminum, gold, silver, copper, titanium, and alloys thereof. Examples of the hollow resin particles include hollow resin particles, of which the description is provided in the specifications such as U.S. Pat. No. 4,880,465 and Japanese Patent No. 3562754. The hollow resin particles have hollows in the interiors thereof, and the outer shells thereof are formed of a liquid-permeable resin. The hollow resin particles can be used as a white pigment.

Hereinafter, the white ink composition, which is typically used as a liquid stored in the liquid storage portion 10, will be described. The white ink composition may include a resin to fix the pigment. Examples of the resin include a polyvinyl alcohol, polyethylene glycol, a polyacrylic acid, polyurethane, polyacrylamide, a cellulose derivative, and the like. In terms of the product name, acrylic resins (for example, Almatex, manufactured by Mitsui Chemicals, Inc.), urethane resins (for example, WBR-022U, manufactured by Taisei Fine Chemical Co., Ltd.) and the like can be used.

The white ink composition preferably contains one which is selected from between alkane diol and glycol ether. Alkane diol and glycol ether increase wettability to a recording surface such as a medium to be ejected, and thus increase permeability of ink.

Examples of alkane diol preferably include 1,2-alkane diol with the number of carbons of 4 to 8 such as 1,2-butanediol, 1,2-pentanediol, 1,2-hexanediol, 1,2-heptanediol, and 1,2-octanediol. Among these, 1,2-hexanediol, 1,2-heptanediol, and 1,2-octanediol with the number of carbons of 6 to 8 are more preferably used due to particularly high permeability to a medium to be ejected.

Examples of glycol ether include a lower alkyl ether of a polyhydric alcohol such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, dipropylene glycol monomethyl ether, dipropylene glycol monoethyl ether, triethylene glycol monomethyl ether, triethylene glycol monobutyl ether, and tripropylene glycol monomethyl ether. Among these, when using triethylene glycol monobutyl ether, excellent recording quality can be obtained.

In addition, the white ink composition preferably contains an acetylene glycol surfactant or a polysiloxane surfactant. An acetylene glycol surfactant or a polysiloxane surfactant increases wettability to a recording surface such as a medium to be ejected, and thus increase permeability of ink.

Examples of acetylene glycol surfactant include 2,4,7,9-tetramethyl-5-decyne-4,7-diol, 3,6-dimethyl-4-octyne-3,6-diol, 3,5-dimethyl-1-hexyne-3-ol, 2,4-dimethyl-5-hexyne-3-ol, and the like. In addition, as the acetylene glycol surfactant, commercially available products can be used. For example, Orfin (registered trade name) E1010, Orfin STG, Orfin Y (manufactured by Nissin Chemical Industry Co., Ltd.), and Surfynol (registered trade name) 104, 82, 465, 485, and TG (manufactured by Air Products and Chemicals Inc.) can be used.

As the polysiloxane surfactant, commercially available products can be used. For example, BYK-347, BYK-348 (manufactured by BYK-Chemie Japan KK) and the like can be used.

Further, the white ink composition may also contain other surfactants such as an anion surfactant, a non-ionic surfactant, and an ampholytic surfactant.

The white ink composition preferably contains a polyhydric alcohol. The polyhydric alcohol can suppress drying of ink and prevent ink clogging in the ejection head when the white ink composition is applied to an ink jet recording device.

Examples of the polyhydric alcohol include ethylene glycol, diethylene glycole, triethylene glycole, polyethylene glycol, polypropylene glycol, propylene glycol, butylene glycol, 1,2,6-hexanetriol, thioglycol, hexylene glycol, glycerin, trimethylolethane, trimethylolpropane, and the like.

The white ink composition may contain water as a solvent. As the water, pure water or ultrapure water such as ion-exchanged water, ultrafiltrated water, reverse osmosis water, or distilled water is preferably used. Particularly, the sterilized water, which is obtained by irradiating ultraviolet rays on or adding hydrogen peroxide to the aforementioned waters, is preferably used since it is possible to prevent mold and bacteria from being generated over a long period of time.

Further, the white ink composition may contain additives as needed. Examples of the additives include a fixing agent such as a water-soluble rosin, an antifungal agent and an antiseptic agent such as sodium benzoate, an antioxidizing agent and an ultraviolet absorber such as allophanates, a chelating agent, a pH adjuster such as triethanolamine, an oxygen absorber, and the like. These additives can be used alone or in combination of two or more of them.

As an example of the white ink composition, the water-based ink composition has been described, but an ultraviolet curable ink or the like may be used. When using an ultraviolet curable ink, for example, a photopolymerization initiator can be exemplified as a component which may precipitate.

1.2. Liquid Supply Tube

The liquid stirring device 100 according to this embodiment may have the liquid supply tube 30. The liquid supply tube 30 includes liquid supply tubes 30*a* and 30*b*. In FIG. 1, The liquid supply tube 30*a* connects the liquid storage portion 10 to the container 20 and can allow the liquid which is stored in the liquid storage portion 10 to flow to the container 20. The liquid supply tube 30*b* connects the container 20 and the ejection head 33 and can allow the liquid to flow to the ejection head 33.

1.3. Container and Stirrer

The liquid stirring device 100 according to this embodiment is mounted on the carriage 50A. When the liquid stirring device 100 including the container 20 is mounted on the carriage 50A, there is no need to separately provide a mechanism for moving only the container 20 and the container 20 can be moved using the movement mechanism of the carriage 50A.

In addition, as shown in FIG. 1, the liquid stirring device 100 according to this embodiment has the stirrer 15 which is movably disposed in the container 20.

The stirrer 15 may have a shape so as to be movable within the container 20. For example, the stirrer may have a spherical body, an ellipsoidal body (for example, like a rugby ball), a circular cylindrical body, an elliptical column body, a polygonal column body, a rectangular parallelepiped body, a cubic body, a polyhedral body, or the like. Among these, when the stirrer 15 has a spherical body or an ellipsoidal body, the stirrer 15 easily moves in the container 20 and stirring of the liquid can be efficiently performed.

Examples of the material for the stirrer 15 include glass having silicate as a main component, aluminum oxide, zirconium oxide, metal (for example, aluminum, titanium, chromium, nickel, iron, and alloys containing any of these) and the like.

The direction, angle, and the like of the installation of the container 20 are not particularly limited if the stirrer 15 moves in the container 20 on the basis of the reciprocation of the carriage 50A.

The shape of the container 20 of the liquid stirring device 100 according to this embodiment is not limited to a rectangular parallelepiped shape, a cylinder shape, an elliptic cylinder shape and the like, and may have a cubic body, a circular cylindrical body or the like. In this specification, the shape of the container 20 is the shape of the interior of the container 20 with the stirrer 15 disposed therein.

Figure 2A:
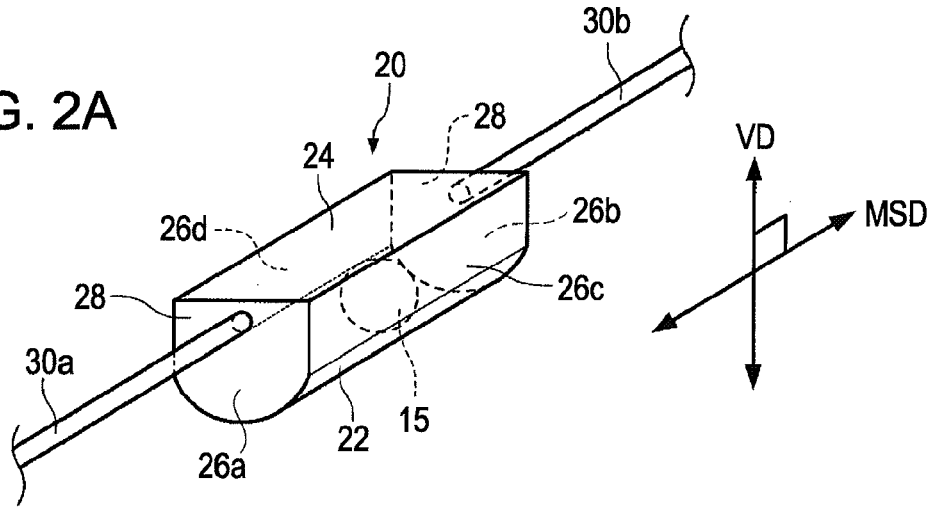
FIGS. 2A to 2C are perspective views of a container of the liquid stirring device according to the embodiment.

As shown in FIG. 2A, the container 20 has a shape which is surrounded by a bottom surface portion 22, an upper surface portion 24 opposed to the bottom surface portion 22, and side surface portions 26*a*, 26*b*, 26*c* and 26*d* connected to the bottom surface portion 22 and the upper surface portion 24. The container 20 has the first side surface portion 26*a* and the second side surface portion 26*b* opposed to each other in the longitudinal direction MSD shown in the drawing. The liquid supply tube 30*a* is connected to the first side surface portion 26*a* and the liquid supply tube 30*b* is connected to the second side surface portion 26*b*. Further, the container 20 has the third side surface portion 26*c* and the fourth side surface portion 26*d* opposed to each other in the direction MSD in which the stirrer 15 is moved and in a direction perpendicular to the vertical direction VD. The connection positions between the liquid supply tube 30*a* and the first side surface portion 26*a* and between the liquid supply tube 30*b* and the second side surface portion 26*b* are not particularly limited, and these may be connected to each other in any of the bottom surface portion 22, the upper surface portion 24, the third side surface portion 26*c* and the fourth side surface portion 26*d*. In addition, both of the liquid supply tubes 30*a* and 30*b* may be connected to the same surface of the container 20.

Figure 2B:
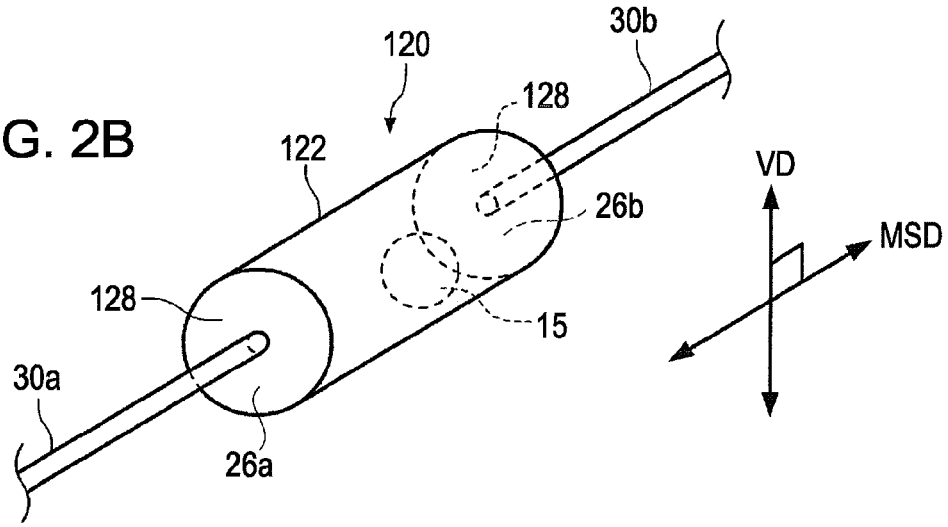

In addition, for example, as shown in FIG. 2B, when the upper surface portion, the bottom surface portion, the third side surface portion and the fourth side surface portion are formed integrally with each other, that is, form a so-called cylinder portion 122, the cylinder portion 122 include the upper surface portion, the bottom surface portion, the third side surface portion and the fourth side surface portion.

A central portion 18 which is a main region in which the stirrer 15 moves will be described. In the invention, the central portion is a region which is surrounded by the bottom surface portion, the upper surface portion, and the straight lines connecting the bottom surface portion and the upper surface portion when viewed from the cross-section in the longitudinal direction of the container. A specific description will be given using the drawings.

Figure 3A:
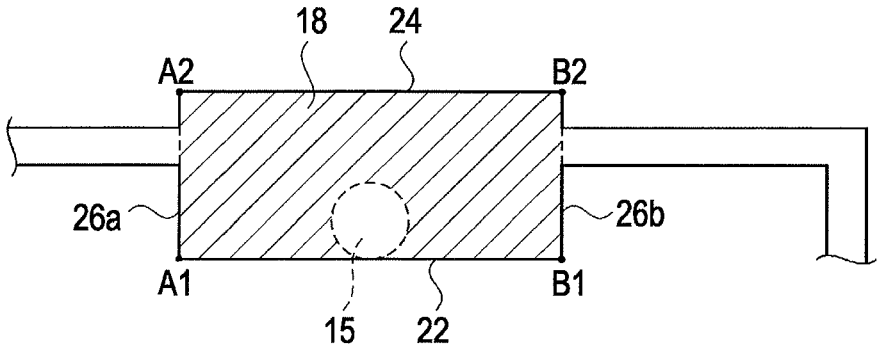
FIGS. 3A to 3C are diagrams illustrating a central portion of the container according to the embodiment.

In FIG. 3A, the container has the shape of a rectangular parallelepiped body. Neither of the first and second side surface portions 26*a* and 26*b* have a curve. In this case, the region (oblique line region in FIG. 3A) which is surrounded by the bottom surface portion 22, the upper surface portion 24, the straight line connecting A1 of the bottom surface portion 22 and A2 of the upper surface portion 24, and the straight line connecting B1 of the bottom surface portion 22 and B2 of the upper surface portion 24 corresponds to the central portion 18. That is, in the case of the shape shown in FIG. 3A, the entire interior of the container 20 becomes the central portion 18.

Figure 3B:
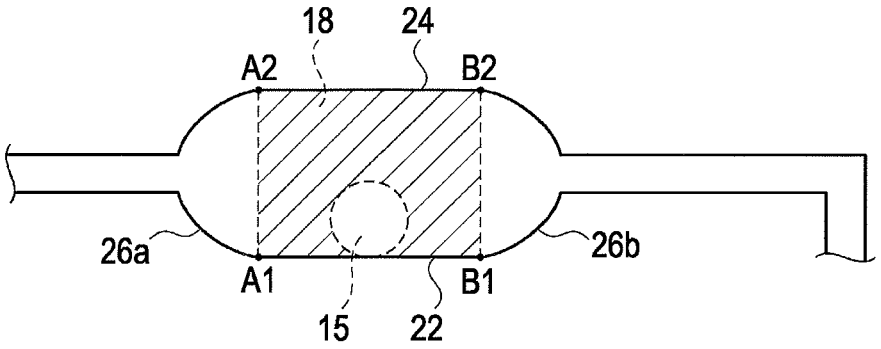

In addition, in FIG. 3B, differently from FIG. 3A, both of the first and second side surface portions 26*a* and 26*b* are curved to the outside. In this case, the region (oblique line region in FIG. 3B) which is surrounded by the bottom surface portion 22, the upper surface portion 24, the straight line connecting A1 of the bottom surface portion 22 and A2 of the upper surface portion 24, and the straight line connecting B1 of the bottom surface portion 22 and B2 of the upper surface portion 24 corresponds to the central portion 18. That is, the central portion 18 does not include the first and second side surface portions 26*a* and 26*b*.

Figure 3C:
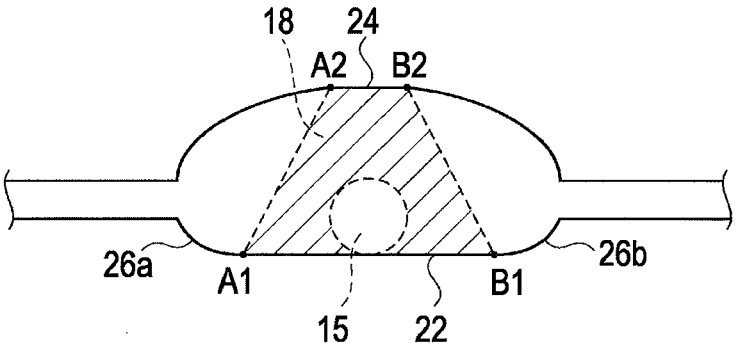

Further, in FIG. 3C, the bottom surface portion 22 and the upper surface portion 24 have different sizes. Also in this case, the region (oblique line region in FIG. 3C) which is surrounded by the bottom surface portion 22, the upper surface portion 24, the straight line connecting A1 of the bottom surface portion 22 and A2 of the upper surface portion 24, and the straight line connecting B1 of the bottom surface portion 22 and B2 of the upper surface portion 24 corresponds to the central portion 18.

Regarding a preferred shape of the container 20, the bottom surface portion 22 preferably has a shape which is curved downward in the vertical direction when viewed from the cross-section in a direction which is perpendicular to the direction in which the stirrer 15 is moved and is perpendicular to the vertical direction. Through having such a shape, precipitates are easily collected in the curved portion and thus stirring efficiency is improved. In addition, the shape of the stirrer 15 preferably partially has the same shape as that of the bottom surface portion 22. For example, when the bottom surface portion 22 has a shape which is curved downward in the vertical direction, the stirrer 15 may have a spherical or ellipsoidal shape. Accordingly, the contacting surface between the stirrer 15 and the bottom surface portion 22 increases and thus the stirring efficiency of precipitated precipitates is improved.

The shape of a connecting portion between the side surface portion 26 and the bottom surface portion 22 preferably has partially the same shape as that of the stirrer 15. For example, when the shape of the connecting portion has a curve, the shape of the stirrer 15 may have a spherical or ellipsoidal shape. Accordingly, the stirrer 15 easily comes into contact with the connecting portion, and stirring efficiency of the precipitates precipitating in the vicinity of the connecting portion increases.

In addition, the shape of the connecting portion between the side surface portion 26 and the bottom surface portion 22 may be preferably curved toward the outside of the container. Accordingly, the clearance gap in the connecting portion is reduced and the amount of precipitates accumulating in the clearance gap can thus be reduced, whereby the stirring efficiency increases.

In greater detail, as shown in FIG. 2A, when the stirrer 15 has a spherical shape and the bottom surface portion 22 of the container 20 has a shape which is curved downward in the vertical direction when viewed from the cross-section in a direction which is perpendicular to the direction in which the stirrer 15 is moved and is perpendicular to the vertical direction, precipitates are easily collected in the curved portion of the bottom surface portion 22, and the contacting surface between the stirrer 15 and the bottom surface portion 22 increases. Therefore, the stirring efficiency of the precipitated precipitates is improved.

Figure 2C:
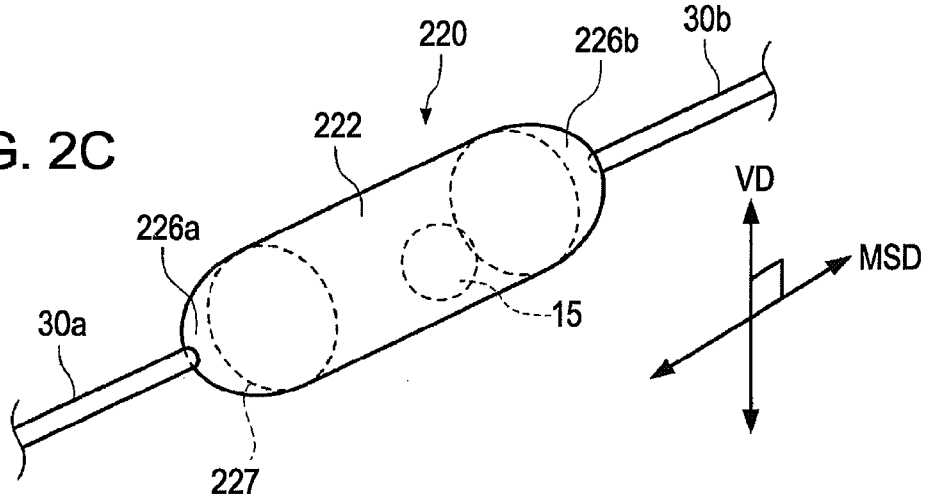

Further, in a container 220 of FIG. 2C, first and second side surface portions 226*a* and 226*b* have a shape which is curved toward the outside of the container 220, the stirrer 15 has a spherical shape, and the upper surface portion, the bottom portion, the third side surface portion and the fourth side surface portion are formed integrally with each other to constitute a cylinder portion 222. Since the container 220 includes the cylinder portion 222, precipitates are easily collected in the curved portion and the contacting surface between the stirrer 15 and the cylinder portion 222 increases, whereby the stirring efficiency of the precipitates is improved. In addition, in contacting portions 227 between the cylinder portion 222 and the first and second side surface portions 226*a* and 226*b*, the contacting surface between the contacting portion 227 and the stirrer 15 increases, and thus the amount of precipitates accumulating in the clearance gap is also reduced. Therefore, the stirring efficiency increases.

In FIG. 2C, both of the first and second side surface portions 226*a* and 226*b* have a shape which is curved toward the outside of the container 220. However, both of them do not necessarily have a shape which is curved toward the outside, and similar effects to the above-described effects are obtainable even when only one has a shape which is curved toward the outside.

1.4. Stirring Means

Figure 4:
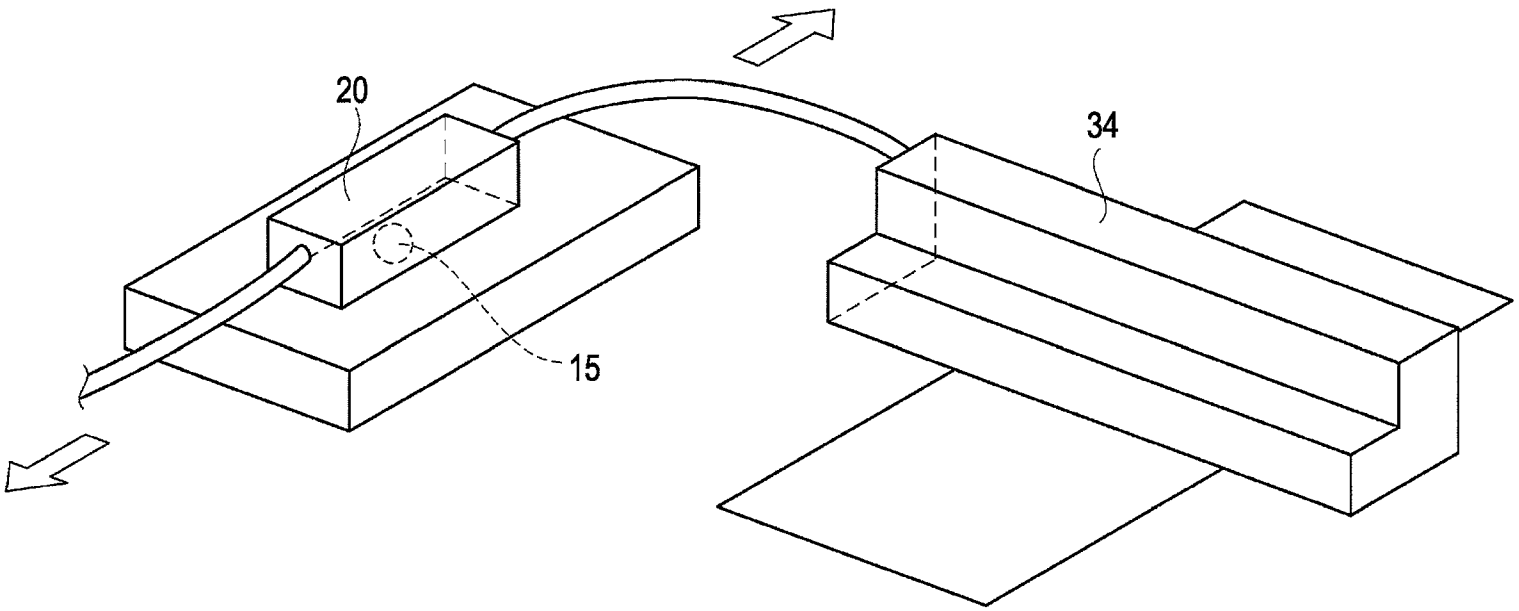
FIG. 4 is a perspective view when an ejection head according to the embodiment is a line-type ejection head.
Figure 5A:
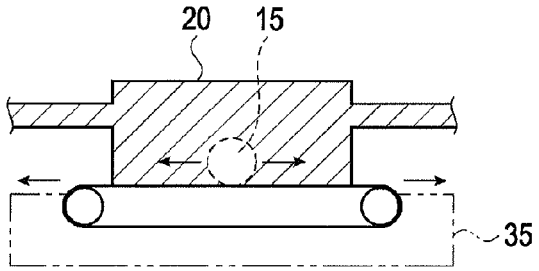
FIGS. 5A to 5C are diagrams showing modified examples of the liquid stirring device according to the embodiment.

In this embodiment, stirring is performed by using the stirrer 15 on the basis of the reciprocation of the carriage 50A as described above. However, the stirring means is not particularly limited thereto. For example, mounting on a carriage including an XY movement mechanism (which moves in the X-Y plane) also may be employed as described in JP-A-2002-225255. In addition, as shown in FIG. 4, the container 20 may be disposed beside a line-type ejection head 34. In this case, as in FIG. 5A, the container 20 may be installed on a vibration device 35 to move the stirrer 15 in order to perform the stirring.

Figure 5B:
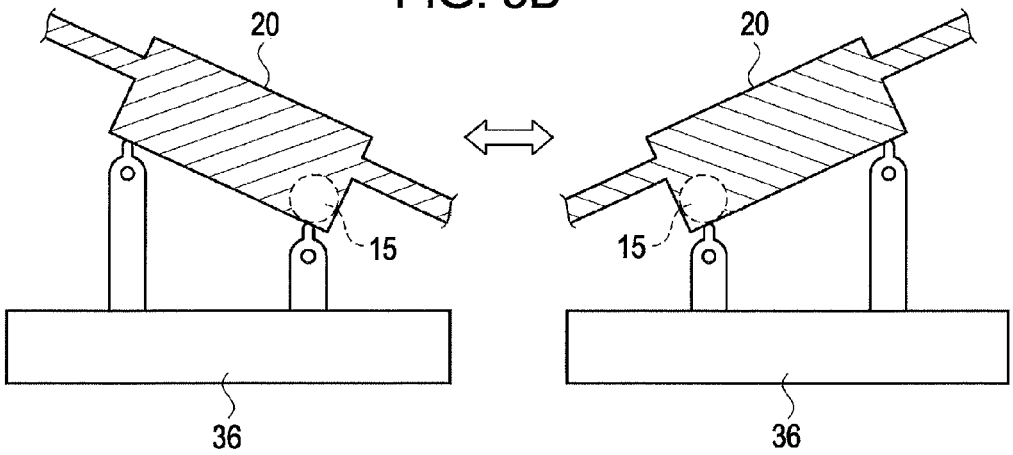
Figure 5C:
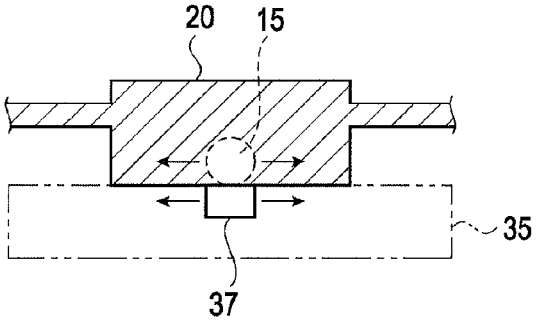

In addition, as shown in FIG. 5B, an inclination device 36 which alternately inclines the container 20 may be used to move the stirrer 15 in order to perform the stirring. Alternatively, as shown in FIG. 5C, a magnet 37 may be moved from the outside the container 20 to move the stirrer 15 made of magnetic metal.

Figure 6:
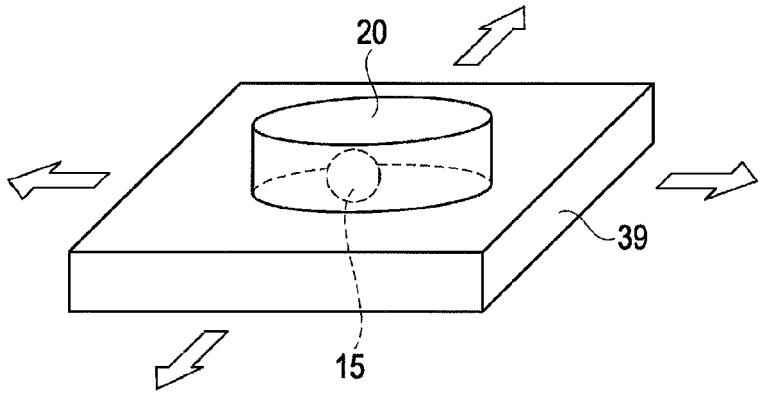
FIG. 6 is a diagram showing a modified example of the liquid stirring device according to the embodiment.

The stirring means according to this embodiment is not limited to the stirring which is performed by moving the stirrer in one direction. For example, as shown in FIG. 6, the container 20 may be installed on a movement device 39 which operates in the X-Y plane to move the stirrer 15 in the container 20 via the movement device 39 in order to perform the stirring. In addition, the liquid stirring device may employ a known stirring means which moves the stirrer 15.

1.5. Relationship Between Container, Stirrer and Precipitates

In the liquid stirring device according to this embodiment, the relationship between a height Ht in the vertical direction in the container and a height Hb in the vertical direction of the stirrer satisfies the following Expression 1.

$$0.40\times Ht\leq Hb\leq 0.90\times Ht \qquad \text{Expression 1}$$

Here, the height Ht in the vertical direction of the interior of the container 20 is the minimum height in the vertical direction in the container 20 when viewed from the cross-section in a predetermined direction (longitudinal direction) in which the height in the vertical direction passes through the highest point. In addition, the height Hb in the vertical direction of the stirrer is the maximum height in the vertical direction of the stirrer 15.

Figure 7A:
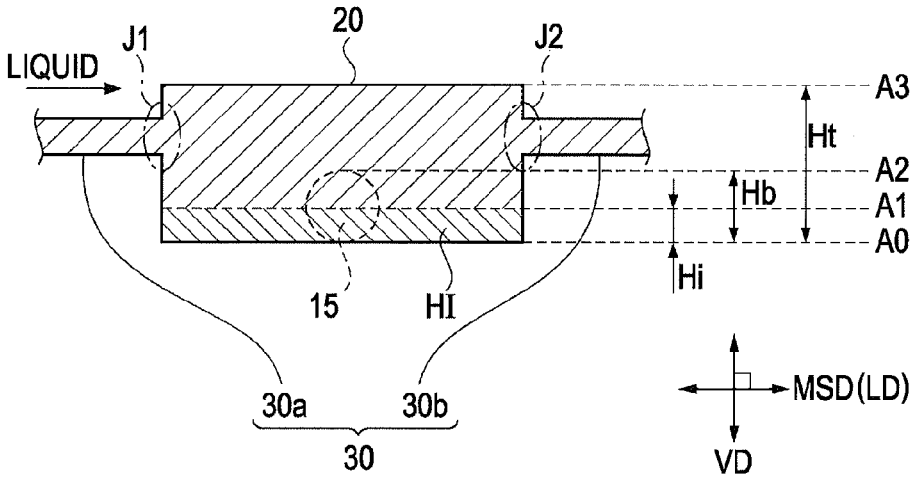
FIGS. 7A and 7B are diagrams showing the relationship between the container according to the embodiment, a stirrer and precipitates.

FIG. 7A is a diagram illustrating a state in which a liquid is supplied into the container 20 and all the components which may precipitate in the liquid have precipitated, including Ht and Hb.

As described above, in the container 20 which is included in the liquid stirring device 100 according to this embodiment, the relationship between Ht and Hb satisfies the above Expression 1. Accordingly, the stirrer 15 can be easily moved in the container 20 and precipitates HI and the liquid in the container 20 can be sufficiently stirred. Particularly, when the precipitates HI do not solidify in the bottom surface portion 22 of the container 20 and the stirrer 15 moves while coming into contact with the bottom surface portion 22 of the container 20, the stirrer 15 can effectively stir the precipitates HI and the liquid in the container 20 when the above Expression 1 is satisfied.

On the other hand, when Hb is less than 40% of Ht, Hb becomes too much smaller than Ht, and thus the liquid stirring efficiency is lowered, and the precipitates HI and the liquid cannot be sufficiently stirred in some cases. In addition, when Hb exceeds 90% of Ht, the stirrer 15 easily receives the resistance of the liquid, and thus the precipitates HI and the liquid cannot be sufficiently stirred in some cases.

Further, in the container 20 which is included in the liquid stirring device 100 according to this embodiment, the relationship between a height Hi in the vertical direction of the precipitates HI which may generate in the container 20, Ht and Hb preferably satisfies the following Expressions 2-1 and 2-2, as well as satisfying the above Expression 1.

$$Hi+Ht\leq 0.26 \qquad \text{Expression 2-1}$$

$$2.50\times Hi\leq Hb\leq 0.90\times(Ht-Hi) \qquad \text{Expression 2-2}$$

The height Hi in the vertical direction of the precipitates HI is the maximum height of the precipitates HI when a liquid containing a component which may precipitate at the same predetermined concentration as in the liquid storage portion 10 is subjected to complete precipitation on the bottom surface portion 22 in the container 20 and the upper surface of the precipitates HI in the container is made to be level.

Figure 7B:
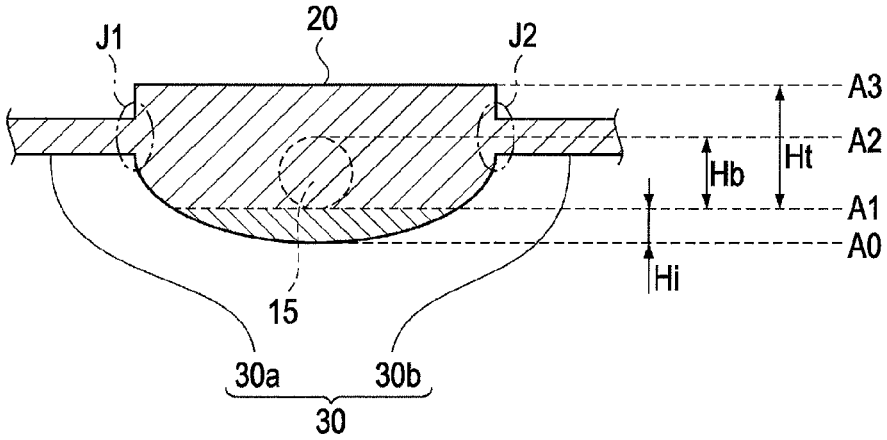

In the container 20 which is included in the liquid stirring device 100 according to this embodiment, Hb is preferably equal to or less than [0.90×(Ht−Hi)] as shown in Expression 2-1. Accordingly, even when the stirrer 15 runs onto the precipitates HI when the precipitates HI solidify, the movement of the stirrer 15 is hindered little and the stirrer 15 can easily move in the container 20, whereby the precipitates HI and the liquid in the container 20 can be sufficiently stirred. The "solidification" is a state in which the stirrer 15 does not come into contact with the bottom surface portion 22 of the container 20 when the stirrer 15 moves on the precipitates HI. The specific positional relationship is shown in FIG. 7B.

On the other hand, when Hb exceeds [0.90×(Ht−Hi)], the stirrer 15 easily receives the resistance of the liquid or the stirrer 15 gets stuck in the container 20 and cannot move therein. Therefore, in some cases, it becomes difficult to stir the liquid and the precipitates HI.

The container 20 which is included in the liquid stirring device 100 according to this embodiment satisfies Expression 2-1. When the container 20 does not satisfy Expression 2-1, values having a relationship satisfying Expression 2-2 cannot be obtained.

In Expression 2-2, Hb is preferably set to be equal to or greater than 2.50 times Hi. Particularly, when the precipitates HI solidify, when Hb is equal to or greater than 2.50 times Hi, the stirrer 15 can move in the container 20 due to the movement of the carriage 50A even when the stirrer 15 is partially buried in the precipitates HI.

On the other hand, when Hb is less than 2.50 times Hi, the stirrer 15 is buried in the precipitates HI, and thus cannot move in some cases.

2. Droplet Ejection Device

A droplet ejection device according to the invention includes the above-described liquid stirring device 100. In this embodiment, a droplet ejection device 300 having the liquid stirring device 100 will be described using an ink jet printer.

Figure 8:
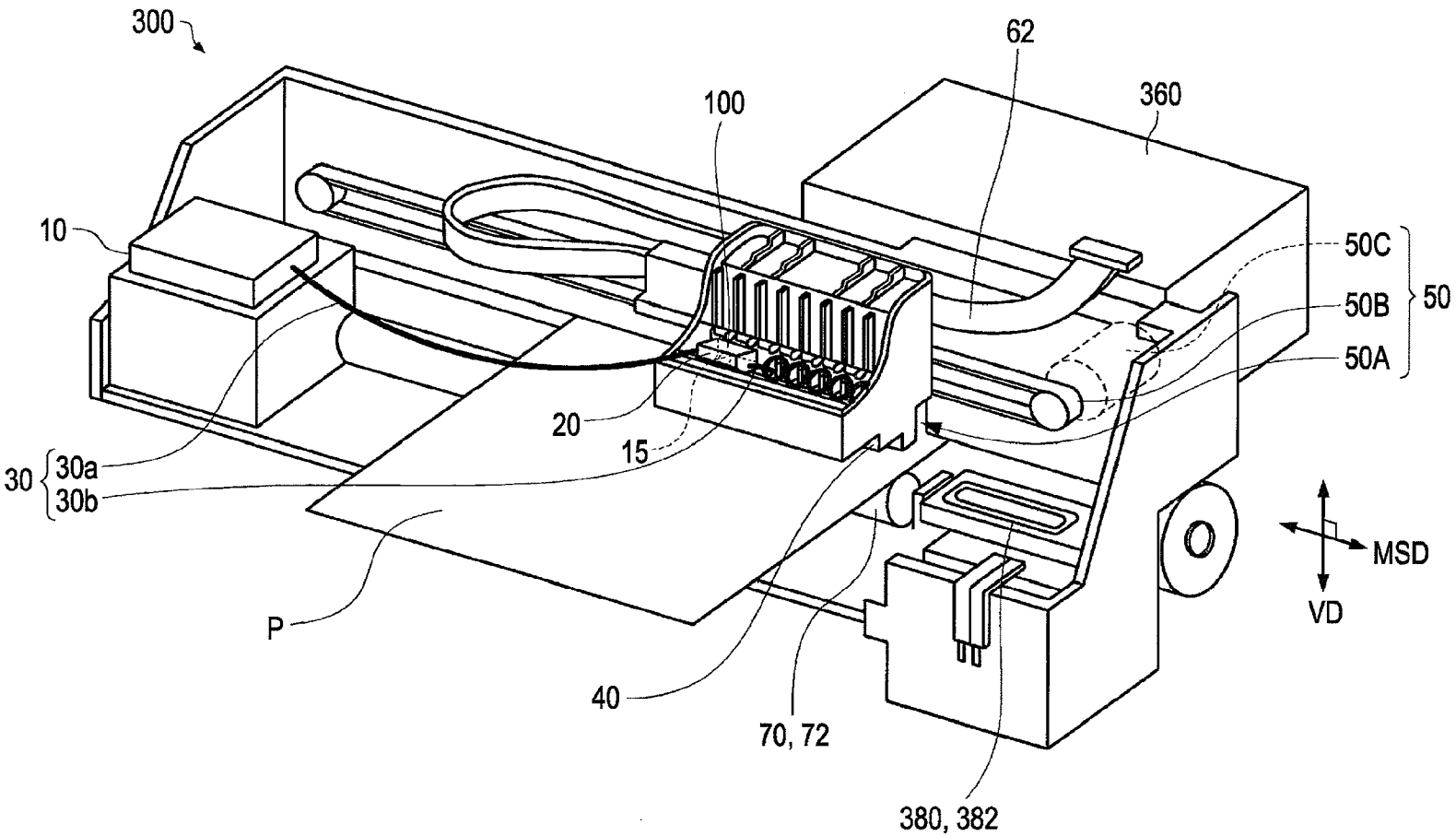
FIG. 8 is a diagram showing a liquid ejection device according to the embodiment.

FIG. 8 is a perspective view schematically showing the droplet ejection device 300 including the liquid stirring device 100. As shown in FIG. 8, the droplet ejection device 300 according to this embodiment includes a control portion 360, a liquid storage portion 10, a liquid supply tube 30, a driving portion 50, and a transport portion 70.

The driving portion 50 may have a carriage 50A, a driving belt 50B, and a carriage motor 50C. The driving, portion 50 is electrically connected to the control portion via a flexible cable 62 and controlled by the control portion. In addition, the driving portion 50 has a function of reciprocating the carriage 50A on which an ejection head 33 is mounted. In greater detail, the driving belt 50B which is connected to the carriage 50A is driven by power of the carriage motor 50C which is a driving source for the carriage 50A, so that the carriage 50A is reciprocated.

The ejection head 33 may have a plurality of nozzles which eject droplets. In addition, a droplet ejection method of the ejection head 33 is not particularly limited, and for example, an ink jet ejection method can be used. As the ink jet ejection method, any known method can be used, and examples thereof include a piezo-type ink jet, thermal-type ink jet and the like.

A medium to be ejected is transported by the transport portion 70, and during the transport, the liquid from the liquid storage portion 10 is ejected by the ejection head 33 which is mounted on the carriage 50A. After that, the medium to be ejected is discharged to the outside of the device by a discharge portion (not shown).

The droplet ejection device 300 of the invention is not only used as an image recording device, such as the exemplified ink jet printer, but also preferably used as a color material spraying device used in manufacturing of a color filter for liquid crystal display, a liquid material spraying device used in the formation of a color filter or an electrode for electrophoretic display, field emission display (FED), and organic EL display, and a bioorganic material spraying device used in bio-chip manufacturing.

3. Examples

Hereinafter, the invention will be described in detail using examples, but is not limited thereto.

3.1. Preparation of White Ink Composition

A white ink composition having the following composition was prepared.

1. First White Ink Composition titanium dioxide (average particle size: 240 nm): 10 mass %
styrene-acrylic acid copolymer: 2 mass %
1,2-hexanediol: 5 mass %
glycerin: 10 mass %
triethanolamine: 0.9 mass %
BYK-348 (manufactured by BYK-Chemie Japan KK): 0.5 mass %
ultrapure water: remainder
total 100 mass %

2. Second White Ink Composition

The content of titanium dioxide in the first white ink composition was adjusted to 20 mass %, and the other components were the same as those of the first white ink composition.

3. Third White Ink Composition

The content of titanium dioxide in the first white ink composition was adjusted to 23 mass %, and the other components were the same as those of the first white ink composition.

3.2. Creation of Samples for Test 3.2.1. Creation of Samples for First Evaluation Test A container having a stirrer disposed therein and having a cylinder shape with a diameter Ht of 15 mm and a height of 65 mm was used and filled with the first white ink composition prepared in the above-described "3.1. (1)", and then was sealed. Next, a centrifuge (Flexpin Bench-Top Centrifuge LC-131, manufactured by TOMY SEIKO CO., LTD.) was used to separate from the liquid components which were contained in the first white ink composition in the container and which might precipitate. The centrifugation was performed for 2 hours under the conditions of the rotation radius of 21 cm and the centrifugal acceleration of 600 rpm. In addition, after centrifugation, the precipitates were not solidified and the stirrer came into contact with the bottom surface of the container. The stirrer had a spherical stainless steel body (specific gravity 7.9), and its diameter Hb was 95% (14.3 mm) of the diameter Ht of the container.

After that, the container was installed in the carriage of an ink jet printer (product name "EPSON PX-G930", manufactured by Seiko Epson Corp.) so that the longitudinal direction of the container was parallel to the movement direction (horizontal direction) of the carriage. In addition, the container was sealed so that supply of the ink composition into the container and supply of the ink composition to the head from the container were not performed.

Next, the carriage reciprocated 100 times a distance of 23 cm at a speed of about 46 cm/sec to stir the first white ink composition in the container. After that, 1 g of the liquid in the container was taken to obtain a sample 1-1 for a first evaluation test.

A sample 1-2 for the first evaluation test was the same as the above "sample 1-1", except for the use of a stirrer with a size 90% (13.5 mm) of the diameter Ht of the container.

A sample 1-3 for the first evaluation test was the same as the above "sample 1-1", except for the use of a stirrer with a size 70% (10.5 mm) of the diameter Ht of the container.

A sample 1-4 for the first evaluation test was the same as the above "sample 1-1", except for the use of a stirrer with a size 50% (7.5 mm) of the diameter Ht of the container.

A sample 1-5 for the first evaluation test was the same as the above "sample 1-1", except for the use of a stirrer with a size 40% (6.0 mm) of the diameter Ht of the container.

A sample 1-6 for the first evaluation test was the same as the above "sample 1-1", except for the use of a stirrer with a size 30% (4.5 mm) of the diameter Ht of the container.

A sample 1-7 for the first evaluation test was the same as the above "sample 1-1", except for not using a stirrer.

A sample 1-8 for the first evaluation test was obtained in the same manner as that for the above "sample 1-1", except for the use of the second white ink composition obtained in the above-described "3.1. (2)". After centrifugation, the precipitates were not solidified and the stirrer came into contact with the bottom surface of the container.

A sample 1-9 for the first evaluation test was obtained in the same manner as that for the above "sample 1-1", except for the use of a container having a cylinder shape with a diameter Ht of 25 mm and a height of 75 mm and the use of a stirrer with a size 95% (23.8 mm) of the diameter Ht of the container.

A sample 1-10 for the first evaluation test was the same as the above "sample 1-9", except for the use of a stirrer with a size 90% (22.5 mm) of the diameter Ht of the container.

A sample 1-11 for the first evaluation test was the same as the above "sample 1-9", except for the use of a stirrer with a size 40% (10.0 mm) of the diameter Ht of the container.

A sample 1-12 for the first evaluation test was the same as the above "sample 1-9", except for the use of a stirrer with a size 30% (7.5 mm) of the diameter Ht of the container.

A sample 1-13 for the first evaluation test was the same as the above "sample 1-1", except for installation of a container having a rectangular parallelepiped body of vertical 15 mm×horizontal 15 mm×height 65 mm with the direction of the height of the container parallel to the movement direction of the carriage and the use of a stirrer having a spherical body with a size 90% (13.5 mm) of the diameter Ht of the container.

A sample 1-14 for the first evaluation test was the same as the above "sample 1-13", except for the use of a stirrer with a size 40% (6.0 mm) of the diameter Ht of the container.

A sample 1-15 for the first evaluation test was the same as the above "sample 1-13", except for the use of a stirrer having a cubic body with a size 40% (6.0 mm) of the diameter Ht of the container.

3.2.2. Creation of Samples for Second Evaluation Test

A container having a stirrer disposed therein and having a cylinder shape with a diameter Ht of 15 mm and a height of 65 mm was used and filled with the first white ink composition prepared in the above-described "3.1. (1)", and then was sealed. Next, a centrifuge was used to separate from the liquid the components which were contained in the first white ink composition in the container and which might precipitate. The centrifugation was performed for 2 hours under the conditions of the rotation radius of 21 cm and the centrifugal acceleration of 600 rpm. After centrifugation, the container was left for a month at 20° C. The precipitates in the container after leaving for a month were solidified. In addition, the stirrer 15 had a spherical stainless steel body (specific gravity 7.9), and its diameter Hb was 95% (14.3 mm) of the diameter Ht of the container.

In addition, the volume of the component (titanium dioxide) which was contained in the first white ink composition in the container and which might precipitate was 8% of the volume of the container. In addition, regarding the component (titanium dioxide) which was contained in the first white ink composition in the container and which might precipitate, the height Hi in the vertical direction of precipitates was 2.06 mm (13.3% of the diameter Ht of the container).

After leaving the container for a month, the container was installed in the carriage of an ink jet printer (product name "EPSON PX-G930", manufactured by Seiko Epson Corp.) so that the longitudinal direction of the container was parallel to the movement direction (horizontal direction) of the carriage. In addition, the container was sealed so that supply of the ink composition into the container and supply of the ink composition to the head from the container were not performed.

Next, the carriage reciprocated 100 times a distance of 23 cm at a speed of about 46 cm/sec to stir the first white ink composition in the container. After that, 1 g of the liquid in the container was taken to obtain a sample 2-1 for a second evaluation test.

A sample 2-2 for the second evaluation test was the same as the above "sample 2-1", except for the use of a stirrer with a size 90% (13.5 mm) of the diameter Ht of the container.

A sample 2-3 for the second evaluation test was the same as the above "sample 2-1", except for the use of a stirrer with a size 80% (12.0 mm) of the diameter Ht of the container.

A sample 2-4 for the second evaluation test was the same as the above "sample 2-1", except for the use of a stirrer with a size 75% (11.3 mm) of the diameter Ht of the container.

A sample 2-5 for the second evaluation test was the same as the above "sample 2-1", except for the use of a stirrer with a size 70% (10.5 mm) of the diameter Ht of the container.

A sample 2-6 for the second evaluation test was the same as the above "sample 2-1", except for the use of a stirrer with a size 60% (9.0 mm) of the diameter Ht of the container.

A sample 2-7 for the second evaluation test was the same as the above "sample 2-1", except for the use of a stirrer with a size 50% (7.5 mm) of the diameter Ht of the container.

A sample 2-8 for the second evaluation test was the same as the above "sample 2-1", except for the use of a stirrer with a size 40% (6.0 mm) of the diameter Ht of the container.

A sample 2-9 for the second evaluation test was the same as the above "sample 2-1", except for the use of a stirrer with a size 30% (4.5 mm) of the diameter Ht of the container.

A sample 2-10 for the second evaluation test was the same as the above "sample 2-1", except for not using a stirrer.

A sample 2-11 for the second evaluation test was the same as the above "sample 2-1", except for the use of the second white ink composition obtained in the above-described "3.1. (2)", and using a stirrer having a spherical body with a size 95% (14.3 mm) of the diameter Ht of the container. The volume of the component (titanium dioxide) which was contained in the second white ink composition in the container and which might precipitate was 16% of the volume of the container. In addition, regarding the component (titanium dioxide) which was contained in the second white ink composition in the container and which might precipitate, the height Hi in the vertical direction of precipitates was 3.30 mm (21.3% of the diameter Ht of the container).

A sample 2-12 for the second evaluation test was the same as the above "sample 2-11", except for the use of a stirrer with a size 90% (13.5 mm) of the diameter Ht of the container.

A sample 2-13 for the second evaluation test was the same as the above "sample 2-11", except for the use of a stirrer with a size 75% (11.3 mm) of the diameter Ht of the container.

A sample 2-14 for the second evaluation test was the same as the above "sample 2-11", except for the use of a stirrer with a size 70% (10.5 mm) of the diameter Ht of the container.

A sample 2-15 for the second evaluation test was the same as the above "sample 2-11", except for the use of a stirrer with a size 55% (8.3 mm) of the diameter Ht of the container.

A sample 2-16 for the second evaluation test was the same as the above "sample 2-11", except for the use of a stirrer with a size 50% (7.5 mm) of the diameter Ht of the container.

A sample 2-17 for the second evaluation test was the same as the above "sample 2-11", except for the use of a stirrer with a size 40% (6.0 mm) of the diameter Ht of the container.

A sample 2-18 for the second evaluation test was the same as the above "sample 2-11", except for the use of a stirrer with a size 30% (4.5 mm) of the diameter Ht of the container.

A sample 2-19 for the second evaluation test was the same as the above "sample 2-11", except for not using a stirrer.

A sample 2-20 for the second evaluation test was the same as the above "sample 2-1", except for using the third white ink composition obtained in the above-described "3.1. (3)", and using a stirrer having a spherical body with a size 95% (14.3 mm) of the diameter Ht of the container. The volume of the component (titanium dioxide) which was contained in the third white ink composition in the container and which might precipitate was 18.5% of the volume of the container. In addition, regarding the component (titanium dioxide) which was contained in the third white ink composition in the container and which might precipitate, the height Hi in the vertical direction of precipitates which were completely precipitated in the container was 3.72 mm (24.0% of the diameter Ht of the container).

A sample 2-21 for the second evaluation test was the same as the above "sample 2-20", except for the use of a stirrer with a size 90% (13.5 mm) of the diameter Ht of the container.

A sample 2-22 for the second evaluation test was the same as the above "sample 2-20", except for the use of a stirrer with a size 70% (10.5 mm) of the diameter Ht of the container.

A sample 2-23 for the second evaluation test was the same as the above "sample 2-20", except for the use of a stirrer with a size 65% (9.8 mm) of the diameter Ht of the container.

A sample 2-24 for the second evaluation test was the same as the above "sample 2-20", except for the use of a stirrer with a size 60% (9.0 mm) of the diameter Ht of the container.

A sample 2-25 for the second evaluation test was the same as the above "sample 2-20", except for the use of a stirrer with a size 50% (7.5 mm) of the diameter Ht of the container.

A sample 2-26 for the second evaluation test was the same as the above "sample 2-20", except for the use of a stirrer with a size 30% (4.5 mm) of the diameter Ht of the container.

A sample 2-27 for the second evaluation test was the same as the above "sample 2-20", except for not using a stirrer.

3.3. Evaluation Tests 3.3.1. First Evaluation Test

Distilled water was added to 1 g of each of the samples 1-1 to 1-15 obtained as described above to dilute the sample 1,000 times. Next, by using a spectrophotometer (product name "Spectrophotometer U-3300", manufactured by Hitachi, Ltd.), the absorbance (Abs value) of the diluted white ink composition at a wavelength of 500 nm was measured. The absorbances of the samples obtained in this manner were compared to the absorbance of the white ink composition before centrifugation and the recovery rate of the absorbance was obtained using the following Expression 3.

$$\text{Recovery Rate(\%) of Absorbance} = 100 \times (\text{Absorbance of Sample})/(\text{Absorbance Before Centrifugation Operation}) \quad \text{Expression 3}$$

The higher the recovery rate of the absorbance is, the better the stirring efficiency of the ink composition is. In addition, the evaluation references in the first evaluation test are classified as follows.

⊙: The recovery rate of absorbance is equal to or greater than 80%

○: The recovery rate of absorbance is equal to or greater than 70% and less than 80%

X: The recovery rate of absorbance is less than 70%

3.3.2. Second Evaluation Test

The recovery rates of the absorbance of the samples 2-1 to 2-27 obtained as described above were obtained in the same manner as in the above "3.3.1. First Evaluation Test". The evaluation references in the second evaluation test are classified as follows.

⊙: The recovery rate of absorbance is equal to or greater than 80%

○: The recovery rate of absorbance is equal to or greater than 70% and less than 80%

X: The recovery rate of absorbance is less than 70%

3.4. Evaluation Results

Table 1 shows the results of the first evaluation test and Tables 2 and 3 show the results of the second evaluation test.

TABLE 1

| Evaluation Sample No. | Used White Ink Composition | Shape of Container | Shape of Stirrer | Height of Container (mm) (Ht) | Height of Stirrer (mm) (Hb) | Ratio of Hb to Ht (Hb/Ht, %) | Evaluation Test Results: Recovery Rate (%) | Evaluation Test Results: Evaluation |
|---|---|---|---|---|---|---|---|---|
| (1-1) | First White Ink Composition | Cylinder Shape | Spherical Body | 15.0 | 14.30 | 0.95 | 40 | X |
| (1-2) | First White Ink Composition | Cylinder Shape | Spherical Body | 15.0 | 13.50 | 0.90 | 82 | ⊙ |
| (1-3) | First White Ink Composition | Cylinder Shape | Spherical Body | 15.0 | 10.50 | 0.70 | 99 | ⊙ |
| (1-4) | First White Ink Composition | Cylinder Shape | Spherical Body | 15.0 | 7.50 | 0.50 | 92 | ⊙ |
| (1-5) | First White Ink Composition | Cylinder Shape | Spherical Body | 15.0 | 6.00 | 0.40 | 86 | ⊙ |
| (1-6) | First White Ink Composition | Cylinder Shape | Spherical Body | 15.0 | 4.50 | 0.30 | 45 | X |
| (1-7) | First White Ink Composition | Cylinder Shape | — | 15.0 | — | — | 15 | X |
| (1-8) | Second White Ink Composition | Cylinder Shape | Spherical Body | 15.0 | 7.50 | 0.50 | 89 | ⊙ |
| (1-9) | First White Ink Composition | Cylinder Shape | Spherical Body | 25.0 | 23.80 | 0.95 | 41 | X |
| (1-10) | First White Ink Composition | Cylinder Shape | Spherical Body | 25.0 | 22.50 | 0.90 | 83 | ⊙ |
| (1-11) | First White Ink Composition | Cylinder Shape | Spherical Body | 25.0 | 10.00 | 0.40 | 87 | ⊙ |
| (1-12) | First White Ink Composition | Cylinder Shape | Spherical Body | 25.0 | 7.50 | 0.30 | 47 | X |
| (1-13) | First White Ink Composition | Rectangular Parallelepiped Body | Spherical Body | 15.0 | 13.50 | 0.90 | 71 | ○ |
| (1-14) | First White Ink Composition | Rectangular Parallelepiped Body | Spherical Body | 15.0 | 6.00 | 0.40 | 72 | ○ |

TABLE 1-continued

| Evaluation Sample No. | Used White Ink Composition | Shape of Container | Shape of Stirrer | Height of Container (mm) (Ht) | Height of Stirrer (mm) (Hb) | Ratio of Hb to Ht (Hb/Ht, %) | Evaluation Test Results: Recovery Rate (%) | Evaluation Test Results: Evaluation |
|---|---|---|---|---|---|---|---|---|
| (1-15) | First White Ink Composition | Rectangular Parallelepiped Body | Cubic Body | 15.0 | 6.00 | 0.40 | 70 | ○ |

TABLE 2

| Sample No. | Used White Ink | Shape of Stirrer | Shape of Container | Height of Container (mm) (Ht) | Height of Stirrer (mm) (Hb) | Ratio of Hb to Ht (Hb/Ht, %) | Evaluation Test Results: Recovery Rate (%) | Evaluation Test Results: Evaluation |
|---|---|---|---|---|---|---|---|---|
| (2-1) | First White Ink Composition | Spherical Body | Cylinder Shape | 15.0 | 14.30 | 0.95 | 40 | X |
| (2-2) | Second White Ink Composition | Spherical Body | Cylinder Shape | 15.0 | 13.50 | 0.90 | 73 | ○ |
| (2-3) | Third White Ink Composition | Spherical Body | Cylinder Shape | 15.0 | 12.00 | 0.80 | 79 | ○ |
| (2-4) | Fourth White Ink Composition | Spherical Body | Cylinder Shape | 15.0 | 11.30 | 0.75 | 81 | ⊙ |
| (2-5) | First White Ink Composition | Spherical Body | Cylinder Shape | 15.0 | 10.50 | 0.70 | 95 | ⊙ |
| (2-6) | First White Ink Composition | Spherical Body | Cylinder Shape | 15.0 | 9.00 | 0.60 | 99 | ⊙ |
| (2-7) | First White Ink Composition | Spherical Body | Cylinder Shape | 15.0 | 7.50 | 0.50 | 92 | ⊙ |
| (2-8) | First White Ink Composition | Spherical Body | Cylinder Shape | 15.0 | 6.00 | 0.40 | 86 | ⊙ |
| (2-9) | First White Ink Composition | Spherical Body | Cylinder Shape | 15.0 | 4.50 | 0.30 | 45 | X |
| (2-10) | First White Ink Composition | — | Cylinder Shape | 15.0 | — | — | 15 | X |
| (2-11) | Second White Ink Composition | Spherical Body | Cylinder Shape | 15.0 | 14.30 | 0.95 | 38 | X |
| (2-12) | Second White Ink Composition | Spherical Body | Cylinder Shape | 15.0 | 13.50 | 0.90 | 70 | ○ |
| (2-13) | Second White Ink Composition | Spherical Body | Cylinder Shape | 15.0 | 11.30 | 0.75 | 75 | ○ |
| (2-14) | Second White Ink Composition | Spherical Body | Cylinder Shape | 15.0 | 10.50 | 0.70 | 98 | ⊙ |
| (2-15) | Second White Ink Composition | Spherical Body | Cylinder Shape | 15.0 | 8.30 | 0.55 | 85 | ⊙ |
| (2-16) | Second White Ink Composition | Spherical Body | Cylinder Shape | 15.0 | 7.50 | 0.50 | 78 | ○ |
| (2-17) | Second White Ink Composition | Spherical Body | Cylinder Shape | 15.0 | 6.00 | 0.40 | 70 | ○ |
| (2-18) | Second White Ink Composition | Spherical Body | Cylinder Shape | 15.0 | 4.60 | 0.31 | 39 | X |
| (2-19) | Second White Ink Composition | — | Cylinder Shape | 15.0 | — | — | 21 | X |
| (2-20) | Third White Ink Composition | Spherical Body | Cylinder Shape | 15.0 | 14.30 | 0.95 | 36 | X |
| (2-21) | Third White Ink Composition | Spherical Body | Cylinder Shape | 15.0 | 13.50 | 0.90 | 72 | ○ |
| (2-22) | Third White Ink Composition | Spherical Body | Cylinder Shape | 15.0 | 10.50 | 0.70 | 79 | ○ |
| (2-23) | Third White Ink Composition | Spherical Body | Cylinder Shape | 15.0 | 9.80 | 0.65 | 83 | ⊙ |
| (2-24) | Third White Ink Composition | Spherical Body | Cylinder Shape | 15.0 | 9.00 | 0.60 | 83 | ⊙ |
| (2-25) | Third White Ink Composition | Spherical Body | Cylinder Shape | 15.0 | 7.50 | 0.50 | 70 | ○ |
| (2-26) | Third White Ink Composition | Spherical Body | Cylinder Shape | 15.0 | 4.50 | 0.30 | 36 | X |
| (2-27) | Third White Ink Composition | — | Cylinder Shape | 15.0 | — | — | 24 | X |

TABLE 3

| Sample No. | Used White Ink | Height of Container (mm) (Ht) | Height of Precipitates (mm) (Hi) | 2.50 × Hi (mm) | 0.90 × (Ht − Hi) (mm) | Height of Stirrer (mm) (Hb) | Evaluation Test Results: Recovery Rate (%) | Evaluation Test Results: Evaluation |
|---|---|---|---|---|---|---|---|---|
| (2-1) | First White Ink Composition | 15.0 | 2.06 | 5.15 | 11.65 | 14.30 | 40 | X |
| (2-2) | First White Ink Composition | 15.0 | 2.06 | 5.15 | 11.65 | 13.50 | 73 | ○ |
| (2-3) | First White Ink Composition | 15.0 | 2.06 | 5.15 | 11.65 | 12.00 | 79 | ○ |
| (2-4) | First White Ink Composition | 15.0 | 2.06 | 5.15 | 11.65 | 11.30 | 81 | ⊙ |
| (2-5) | First White Ink Composition | 15.0 | 2.06 | 5.15 | 11.65 | 10.50 | 95 | ⊙ |
| (2-6) | First White Ink Composition | 15.0 | 2.06 | 5.15 | 11.65 | 9.00 | 99 | ⊙ |
| (2-7) | First White Ink Composition | 15.0 | 2.06 | 5.15 | 11.65 | 7.50 | 92 | ⊙ |
| (2-8) | First White Ink Composition | 15.0 | 2.06 | 5.15 | 11.65 | 6.00 | 86 | ⊙ |
| (2-9) | First White Ink Composition | 15.0 | 2.06 | 5.15 | 11.65 | 4.50 | 45 | X |
| (2-10) | First White Ink Composition | 15.0 | 2.06 | 5.15 | 11.65 | — | 15 | X |
| (2-11) | Second White Ink Composition | 15.0 | 3.30 | 8.25 | 10.53 | 14.30 | 38 | X |
| (2-12) | Second White Ink Composition | 15.0 | 3.30 | 8.25 | 10.53 | 13.50 | 70 | ○ |
| (2-13) | Second White Ink Composition | 15.0 | 3.30 | 8.25 | 10.53 | 11.30 | 75 | ○ |
| (2-14) | Second White Ink Composition | 15.0 | 3.30 | 8.25 | 10.53 | 10.50 | 98 | ⊙ |
| (2-15) | Second White Ink Composition | 15.0 | 3.30 | 8.25 | 10.53 | 8.30 | 85 | ⊙ |
| (2-16) | Second White Ink Composition | 15.0 | 3.30 | 8.25 | 10.53 | 7.50 | 78 | ○ |
| (2-17) | Second White Ink Composition | 15.0 | 3.30 | 8.25 | 10.53 | 6.00 | 70 | ○ |
| (2-18) | Second White Ink Composition | 15.0 | 3.30 | 8.25 | 10.53 | 4.60 | 39 | X |
| (2-19) | Second White Ink Composition | 15.0 | 3.30 | 8.25 | 10.53 | — | 21 | X |
| (2-20) | Third White Ink Composition | 15.0 | 3.72 | 9.30 | 10.15 | 14.30 | 36 | X |

TABLE 3-continued

| Sample No. | Used White Ink | Height of Container (mm) (Ht) | Height of Precipitates (mm) (Hi) | 2.50 × Hi (mm) | 0.90 × (Ht − Hi) (mm) | Height of Stirrer (mm) (Hb) | Evaluation Test Results: Recovery Rate (%) | Evaluation Test Results: Evaluation |
|---|---|---|---|---|---|---|---|---|
| (2-21) | Third White Ink Composition | 15.0 | 3.72 | 9.30 | 10.15 | 13.50 | 72 | ○ |
| (2-22) | Third White Ink Composition | 15.0 | 3.72 | 9.30 | 10.15 | 10.50 | 79 | ○ |
| (2-23) | Third White Ink Composition | 15.0 | 3.72 | 9.30 | 10.15 | 9.80 | 83 | ⊙ |
| (2-24) | Third White Ink Composition | 15.0 | 3.72 | 9.30 | 10.15 | 9.00 | 83 | ⊙ |
| (2-25) | Third White Ink Composition | 15.0 | 3.72 | 9.30 | 10.15 | 7.50 | 70 | ○ |
| (2-26) | Third White Ink Composition | 15.0 | 3.72 | 9.30 | 10.15 | 4.50 | 36 | X |
| (2-27) | Third White Ink Composition | 15.0 | 3.72 | 9.30 | 10.15 | — | 24 | X |

3.4.1. Expression 1

In the first evaluation test, from Table 1, it could be confirmed that when using the containers and the stirrers of the samples 1-2 to 1-5, 1-8, 1-10, 1-11, and 1-13 to 1-15, the recovery rate of the absorbance was excellent for any of these cases and a liquid stirring device having excellent stirring efficiency was obtained. On the other hand, it could be confirmed that when using the containers and the stirrers of the samples 1-1, 1-6, 1-7, 1-9 and 1-12, the recovery rate of the absorbance was poor for any of these cases and a liquid stirring device having poor stirring efficiency was obtained.

From Table 2 of the results of the second evaluation test, it could be confirmed that when using the containers and the stirrers of the samples 2-2 to 2-8, 2-12 to 2-17, and 2-21 to 2-25, the recovery rate of the absorbance was excellent for any of these cases and a liquid stirring device having excellent stirring efficiency was obtained. On the other hand, it could be confirmed that when using the containers and the stirrers of the samples 2-1, 2-9 to 2-11, 2-18 to 2-20, 2-26, and 2-27, the recovery rate of the absorbance was poor for any of these cases and a liquid stirring device having poor stirring efficiency was obtained.

From the above description, it was found that a high stirring efficiency was obtained when satisfying Expression 1.

$$0.40\times Ht\leq Hb\leq 0.90\times Ht \qquad \text{Expression 1}$$

3.4.2. Expressions 2-1 and 2-2

From Table 3 of the results of the second evaluation test, it was shown that when using the containers and the stirrers of the samples 2-4 to 2-8, 2-14, 2-15, 2-23, and 2-24, higher stirring efficiency is obtained even when the precipitates are solidified. On the other hand, it was shown that when using the containers and the stirrers of the samples 2-1 to 2-3, 2-9 to 2-13, 2-16 to 2-22, and 2-25 to 2-27, the movement of the stirrer was extremely hindered due to the precipitates and thus a liquid stirring device having poor stirring efficiency was obtained.

From the above description, it was found that higher stirring efficiency is obtained when satisfying Expressions 2-1 and 2-2.

What is claimed is:

1. A liquid stirring device comprising:

a liquid storage portion in which a liquid containing a component which may precipitate is stored;

a container to which the liquid flows from the liquid storage portion;

a stirrer which is housed in the container and stirs the liquid; and a bottom surface portion which constitutes the interior of the container and in which the stirrer moves, wherein the relationship between a height Ht in the vertical direction of a central portion in the container and a height Hb in the vertical direction of the stirrer satisfies the following Expression 1:

$$0.40\times Ht\leq Hb\leq 0.90\times Ht \qquad \text{Expression 1, and}$$

wherein the component is contained at a predetermined concentration in the liquid stored in the liquid storage portion, and the relationships between a height Hi in the vertical direction of precipitates of the component which is contained in the liquid in the container, Ht, and Hb satisfy the following Expressions 2-1 and 2-2:

$$Hi\div Ht\leq 0.26 \qquad \text{Expression 2-1}$$

$$Hi\div Hi\leq Hb\leq 0.90x(Ht-Hi) \qquad \text{Expression 2-2.}$$

2. The liquid stirring device according to claim 1, wherein the bottom surface portion has a shape which is curved downward in the vertical direction when viewed from the cross-section in a direction which is perpendicular to the direction in which the stirrer is moved and is perpendicular to the vertical direction.

3. The liquid stirring device according to claim 1, wherein the container has a side surface portion which is provided in the direction in which the stirrer is moved, and a connecting portion between the side surface portion and the bottom surface portion has a shape which is curved toward the outside of the container.

4. A liquid ejection device comprising the liquid stirring device according to claim 1.

5. A liquid ejection device comprising the liquid stirring device according to claim 2.

6. A liquid ejection device comprising the liquid stirring device according to claim 3.

* * * * *